US005828393A

United States Patent [19]

Hotomi

[11] Patent Number: 5,828,393

[45] **Date of Patent: *Oct. 27, 1998**

[54] INK JET HEAD FOR JETTTING INK ONTO AN INK CARRIER AND AN INK JET RECORDING APPARATUS FOR FORMING AN INK IMAGE ONTO AN INK CARRIER

[75] Inventor: Hideo Hotomi, Ibaragi, Japan

[73] Assignee: Minolta Co., Ltd., Osaka, Japan

[ * ] Notice: The term of this patent shall not extend beyond the expiration date of Pat. No. 5,477,249.

[21] Appl. No.: 539,778

[22] Filed: Oct. 5, 1995

Related U.S. Application Data

[63] Continuation of Ser. No. 961,523, Oct. 15, 1992, Pat. No. 5,477,249.

[30] Foreign Application Priority Data

Oct. 17, 1991 [JP] Japan ..... 3-269338
Oct. 17, 1991 [JP] Japan ..... 3-269339

[51] Int. Cl.[6] ..... B41J 2/045; B41J 2/06

[52] U.S. Cl. ..... 347/71

[58] Field of Search ..... 347/68, 69, 71

[56] References Cited

U.S. PATENT DOCUMENTS

| | | | |
|---|---|---|---|
| 3,786,517 | 1/1974 | Krause | 346/75 |
| 4,439,780 | 3/1984 | DeYoung et al. | 347/68 |
| 4,493,550 | 1/1985 | Takekida | 355/10 |
| 4,825,227 | 4/1989 | Fischbeck et al. | 347/69 |
| 4,851,926 | 7/1989 | Ishikawa | 358/300 |
| 4,905,024 | 2/1990 | Nishikawa et al. | 346/140 R |
| 4,943,818 | 7/1990 | Hotomi | 346/140 R |
| 5,144,340 | 9/1992 | Hotomi et al. | 346/140 R |
| 5,270,740 | 12/1993 | Naruse et al. | 346/140 R |
| 5,351,183 | 9/1994 | Takahashi et al. | 347/69 |
| 5,477,249 | 12/1995 | Hotomi | 347/71 X |

FOREIGN PATENT DOCUMENTS

| | | |
|---|---|---|
| 0437062 | 7/1991 | European Pat. Off. . |
| 53-12138 | 4/1978 | Japan . |
| 61-57343 | 3/1986 | Japan . |
| 62-111757 | 5/1987 | Japan . |
| 62-199450 | 9/1987 | Japan . |
| 62-199451 | 9/1987 | Japan . |
| 1-235977 | 9/1989 | Japan . |
| 4-247944 | 9/1992 | Japan . |

OTHER PUBLICATIONS

Slaughter, G. T., "Ink Jet Printer/Copier;" IBM Technical Disclosure Bulletin, vol. 27, No. 2, Jul., 1978, pp. 698–699.

*Primary Examiner*—Benjamin R. Fuller
*Assistant Examiner*—Juanita Stephens
*Attorney, Agent, or Firm*—Sidley & Austin

[57] ABSTRACT

An ink jet head for jetting ink onto an ink carrier and an ink jet recording apparatus for forming an ink image onto an ink carrier. The ink jet head has a first plate having a plurality of first portions, each first portion having a bottom hollowed from a first surface of the first plate; and a second plate, provided separately from the first plate, having a plurality of second portions corresponding to the first portions, respectively, each second portion having a top which protrudes from a second surface of the second plate and has a piezoelectric material, the second surface being in contact with the first surface so that each top of a second portion confronts to a respective one of the first portions, a space between each top of a protruding portion and the respective one of the bottom of a hollow portion defined as an ink room. The ink jet recording apparatus further includes a driver connected with the second portions to apply an input signal.

63 Claims, 14 Drawing Sheets

Fig. 20

| Composition | Ink No.1 | wt (%) | Ink No.2 | wt (%) | Ink No.3 | wt (%) | Ink No.4 | wt (%) |
|---|---|---|---|---|---|---|---|---|
| Dispersion Media | diethylene glycol monobutyl ether | 67 | furfuryl alcohol | 30 | triethylene glycol monobutyl ether | 78 | water | 67 |
| | | | dipropylene glycol monomethyl ether | 53 | | | | |
| Pigment | carbon black (particle diameter ; 0.2μm) | 5 | benzidine pigment (pigment yellow 13) | 6 | quinacridone pigment (pigment red 122) | 7 | copper phthalocyanine pigment (pigment blue 15) | 8 |
| Dispersion agent | polyoxy ethylene ethylether nonion | 5 | ethylsulfuric acid sodium salt anion of trioxyethylene octyether | 3 | same as left | 4 | nonion surfactant (Emargen A-60 :Kao corporation) | 5 |
| Resin | borneol (masking agent) | 5 | polyvinyl butyral | 5 | rosin | 6 | polyvinyl alcohol | 44 |
| Adduct | water (anti-spreading) | 18 | polyethylene glycol | 3 | same as left | 4 | ethylene glycol | 8 |
| | | | | | | | propylene glicol | 7 |
| | | | | | perfume | 1 | anti-septics (Proxcel GXL : ICI-Pharma LTD.) | 0.5 |
| | | | | | | | sodium hydroxide | 0.1 |

INK JET HEAD FOR JETTTING INK ONTO AN INK CARRIER AND AN INK JET RECORDING APPARATUS FOR FORMING AN INK IMAGE ONTO AN INK CARRIER

This application is a continuation of application Ser. No. 07/961,523, filed Oct. 15, 1992, now U.S. Pat. No. 5,477, 249.

BACKGROUND OF THE INVENTION (1) Field of the Invention

This invention relates to an apparatus and method for forming images by jetting ink towards an image carrier.

(2) Description of the Related Art

Well known as ink jet image forming apparatus are those applying ink with vibrational energy or electrostatic energy in order to spout it towards a recording medium.

The former includes a Kayser method ink jet recording apparatus (Japanese Patent Publication No. 53-12138) that applies ink held in an ink holding device with vibrational energy generated by piezoelectric vibrators so that the ink is spouted from an orifice.

The latter includes a slit jet recording apparatus (Refer to Denshi Tsuushin Gakkai Ronbunshi Vol: J68-C, No. 2,1985) that has an ink holding device having a slit for ink to jet therefrom to a recording medium, and that is provided with recording electrodes in the slit corresponding to many dots, provided with a counter electrodes behind the recording medium. According to this apparatus, each recording electrode is provided with a voltage responding to image data; these electrodes having voltage applied thereto and the counter electrodes generate the electrostatic field and, as a consequence, the ink is jetted towards the recording medium by the electrostatic attraction force.

The latter also includes such an apparatus as disclosed in U.S. Pat. No. 4,493,550 (Japanese Patent Publication No. 1-40985) in which ink is applied with electrostatic energy by forming electrostatic latent images on the surface of a photoconductive body. A number of holes of a rotatable cylindrical sleeve facing the surface of the photoconductive body are filled with ink so that the electrostatic latent images are bias developed.

The latter further includes an apparatus disclosed in Japanese Patent Application No. 1-235977 in which a development roll is supplied with liquid developer by a cylinder having supply holes, and the liquid developer applied on the roll makes contact with a photoconductive body in order to develop electrostatic latent images.

However, according to the above-mentioned Kayser method ink Jet recording apparatus, the volume of the ink holding device must be large enough to accommodate a large amount of vibrational energy to jet ink. Consequently, a high density multi-nozzle apparatus is hard to be realized.

According to the type including the slit jet recording apparatus, the distance between the recording electrodes can not be shorter than a certain length to avoid cross talks between adjacent recording electrodes. This also makes it difficult to realize a high density multi-nozzle apparatus. In addition, the recording electrodes must be driven separately so as not to cause electrostatic repulsion of ink drops, so that the recording speed is deteriorated.

According to the type including the apparatus disclosed in Japanese Patent Publication No. 1-40985, there are the following problems: first, ink may be evaporated or decomposed during a long term storage, which leads to changing development conditions, secondly, considerable high bias voltage required for development raises the product cost of the apparatus, and thirdly, ink has little color variation and the control of a resistance value is difficult because the ink used for such apparatuses must have a conductivity below about $10^3$ Ωcm.

According to the type including the apparatus disclosed in Japanese Patent Application No. 1-235977, there are problems of ink trailing and density changes of the liquid developer caused by evaporation of Isopar.

SUMMARY OF THE INVENTION

The object of this invention is to provide an apparatus and method for forming images, capable of producing high quality images by the use of high density multi-nozzles and various kinds of ink, as well as improving the recording speed and reducing the amount of energy to be consumed.

The above-mentioned object can be achieved by jetting recording liquid onto an image carrier, applying both vibrational energy and electrostatic energy at the same time.

As a result, each energy is less demanded. Thus, not only a unit required to supply vibrational energy to the recording liquid can be minimized, but also the distance between nozzle holes can be shortened because it is more difficult for the vibrational waves become hard to affect each adjacent hole. Therefore, realizing an apparatus having high density multi-nozzles and improved image quality can be made easier.

Moreover, such an apparatus makes it possible to use high viscosity ink which is hard to be jetted only by vibrational energy or high resistance ink which is hard to be jetted only by electrostatic energy such as ink with dispersed pigment in an organic solvent.

Piezoelectric vibrators can be used to apply ink with vibrational energy.

Electrodes can be provided to inject charges into the recording liquid in order to make the best of electrostatic energy.

Both or one of vibrational energy and electrostatic energy can be controlled in order to form images.

Electrostatic energy can be applied by electrostatic latent images formed onto the photosensitive body.

BRIEF DESCRIPTION OF THE DRAWINGS

These and other objects, advantages and features of the invention will become apparent from the following description thereof taken in conjunction with the accompanying drawings which illustrate a specific embodiment of the invention. In the drawings:

FIG. 20 is a table showing the compositions of ink made on an experimental basis.

DESCRIPTION OF THE PREFERRED EMBODIMENTS

[Embodiment 1]

Figure 1:
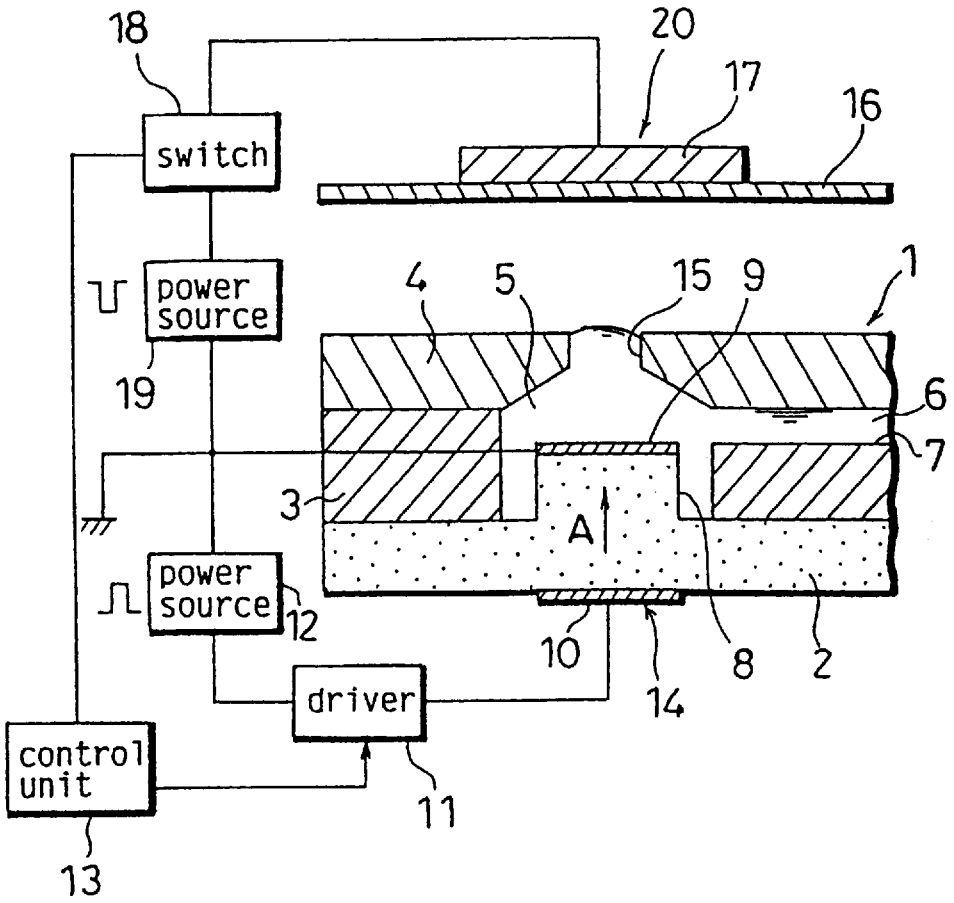
FIG. 1 is a sectional view of the image forming apparatus of an embodiment of this invention in a stopped state.
Figure 2:
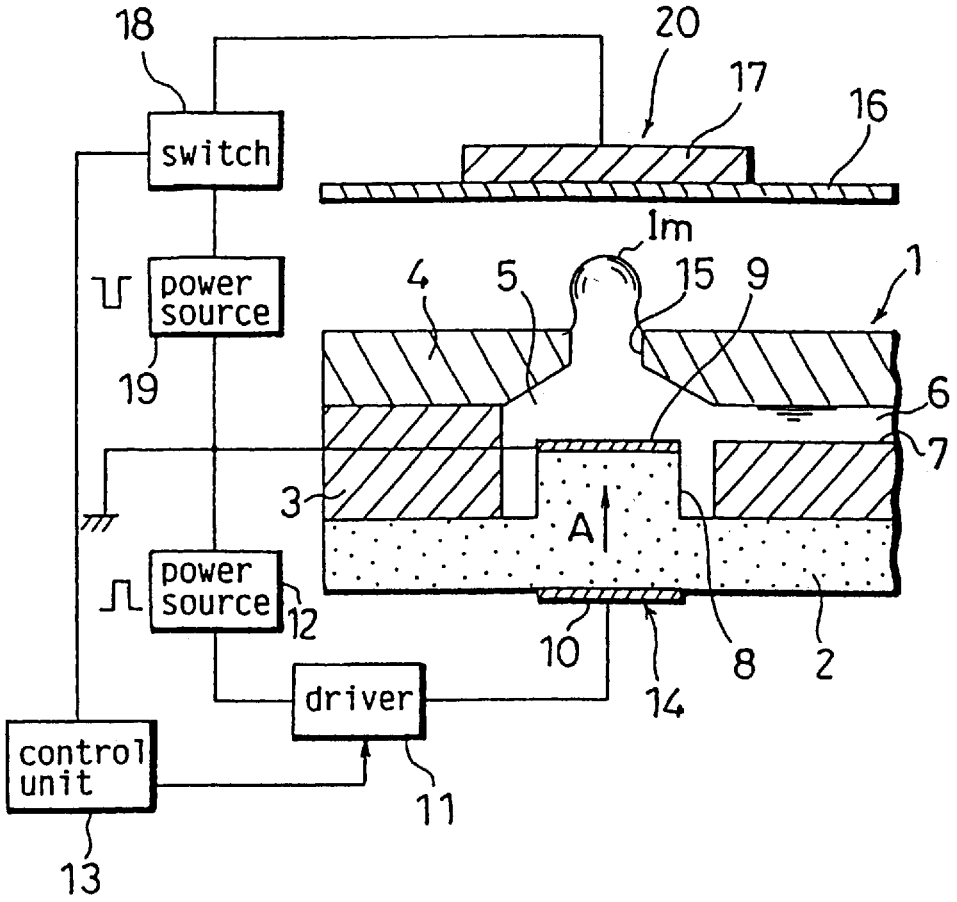
FIG. 2 is a sectional view of the same when vibrational energy is being applied thereto.
Figure 3:
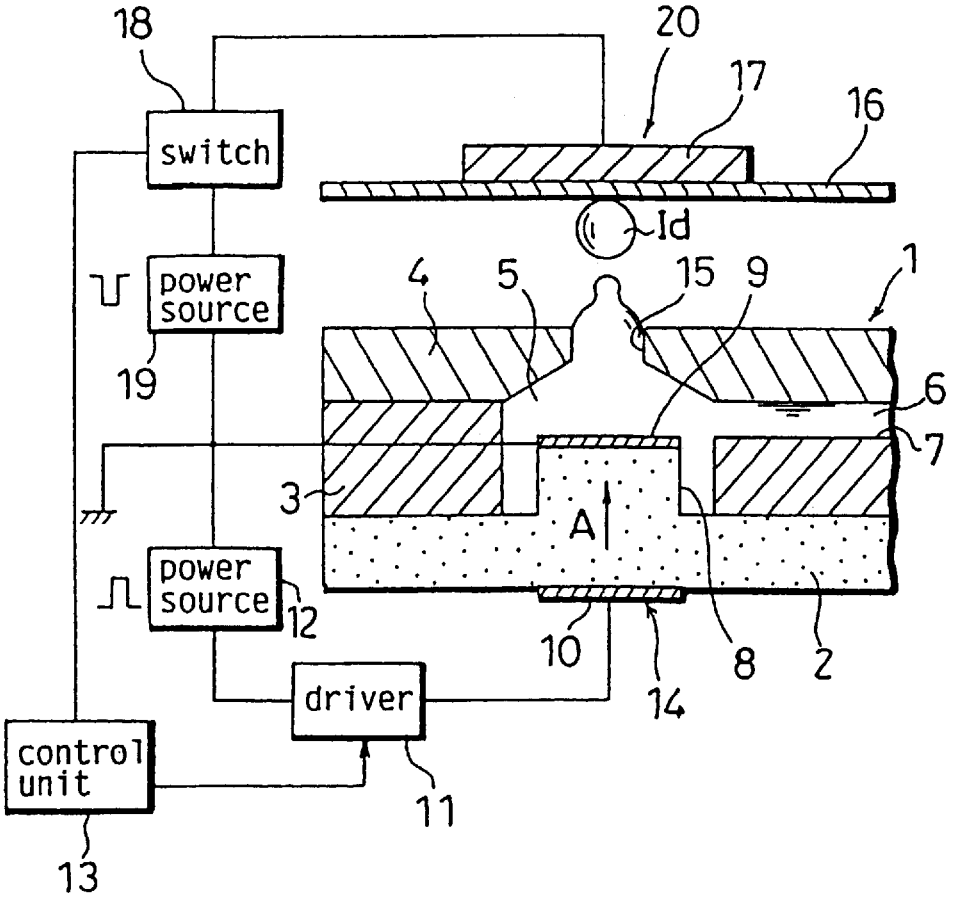
FIG. 3 is a sectional view of the same when both vibrational energy and electrostatic energy are being applied thereto.

The following is a description of the image forming apparatus of a first embodiment of this invention referring to FIGS. 1 through 3.

In FIG. 1, the print head 1 of the image forming apparatus comprises a piezo plate 2 polarizing in the direction indicated by an arrow A, an ink supply passage formation member 3 provided thereon, and a nozzle plate 4 further provided thereon. Moreover, an ink room 5 and an inlet 7 to put ink thereto are formed by taking away a portion of the ink supply passage formation member 3.

The piezo plate 2 has a thickness of about 100 μm to 5 mm, including a protruding portion 8 protruding into the ink room 5. This portion 8 is a right square pole of about 30 μm to 250 μm in width, 50 μm to 1 mm in depth, and 40 μm to 1 mm in height.

The piezo plate 2 is provided with a common grounding electrode 9 on top of the protruding portion 8, and a driving electrode 10 on the opposite side. The driving electrode 10 is connected, via a driver 11, with a power source 12, which generates voltage in the range of about 10V to 500V. A predetermined amount of voltage is applied between the two electrodes by a control unit 13 powering the driver 11 on, so that the two electrodes and the piezo plate 2 therebetween are vibrated in the thickness direction of the plate 2. This means that these three components constitute a piezoelectric vibrator 14. AC voltage of 1 kHz to 10 MHz may be added to voltage generated by the power source 12.

The nozzle plate 4 has a thickness of about 25 μm to 1 mm, including a nozzle hole 15, whose cross section can be a circle having a diameter in the range of about 20 μm to 200 μm, or either an oval or a square equivalent thereto, leading out of the ink room 5 to outside the nozzle plate 4. The inside of the nozzle hole 15 is tapered in order to smoothly spout the ink out.

A counter electrode 17 is provided in a position touching the back side of recording paper 16 fed above the hole 15. The counter electrode 17 is connected, via a switch 18, with another power source 19, which generates voltage about 300V to 1 KV. A predetermined amount of voltage is applied between the common grounding electrode 9 and the counter electrode 17 by the control unit 13 powering the switch 18 on, so that the electrostatic field is generated between the two electrodes, and ink charged by touching the common grounding electrode 9 is jetted onto the recording paper 16 by the electrostatic attraction force. This means that the common grounding electrode 9, the counter electrode 17, the switch 18, and the power source 19 constitute the electrostatic field forming device 20, which produces electrostatic energy to jet the ink 6 in the ink room 5 toward the recording paper 16.

The distance between the hole 15 and the recording paper 16 is set in the range about 0.2 to 5 mm. This distance makes it easy to keep the ink 6 away from the recording paper 16 as well as preventing it from not reaching the recording paper 16 by electrostatic resiliency caused among charged ink particles of the ink 6.

The cross-sectional area of the inlet 7 is set below 90% of the minimum sectional area of the hole 15 in order to avoid counterflow of the ink 6.

The control unit 13 powering on the driver 11 and a single or continuous application of pulse voltage to the piezoelectric vibrator 14 makes the vibrator 14 vibrate. Consequently, the ink 6 is jetted towards the recording paper 16 through the hole 15 and then forms an ink meniscus Im as shown in FIG. 2.

In addition, the control unit 13 powering on the switch 18 and the electrostatic field forming device 20 forming the electrostatic field between the common grounding electrode 9 and the counter electrode 17 makes electrostatic attraction force attract the ink meniscus Im towards the recording paper 16. As a result, one or some ink drops Id are formed as shown in FIG. 3, jetted towards the recording paper 16, and then adhered thereto.

The control unit 13 may be constructed so that the electrostatic field forming device 20 is put in operation ahead of the piezoelectric vibrator 14. The unit 13 may also be constructed so that the electrostatic field forming device 20 and the piezoelectric vibrator 14 are both put in operation and ended at the same time. The unit 13 may also be constructed so that either the switch 18 or the driver 11 is put in an on-state all the time and the other is turned on upon request.

This means it is unnecessary that the timing of starting/ending of the application of both vibrational energy and electrostatic energy coincides. The ink does not reach the recording paper 16 when jetting force does not work for lack of vibrational energy or electrostatic attraction force does not work for lack of electrostatic energy. Thus, both vibrational and electrostatic energy as required to be applied at the same time for the ink to jet.

Therefore, it is possible to drop the ink 6 on demand, and it becomes unnecessary to recycle ink used in apparatuses where ink is jetted continuously.

Since the common grounding electrode 9 is in contact with the ink 6, charge injection effects are generated depending on a resistance value of the ink 6 when the electrostatic field forming device 20 is put in operation. However, these effects make the ink 6 easier to be jetted towards the recording paper 16. As a result, voltage applied between the common grounding electrode 9 and the counter electrode 17 by the electrostatic field forming device 20 can be low.

The vibrational energy generated by the piezoelectric energy and the electrostatic energy generated by the electrostatic field forming device 20 compliment each other, demanding less power supply than in the case of jetting the ink 6 independently.

Also, the change of the capacity of the ink room 5 caused by the vibration of the piezoelectric vibrator 14 can be decreased, and as a consequence, the print head 1 can be made more compact by reducing the size of the piezoelectric vibrator 14, as well as lowering voltage applied on the electrostatic field forming device 20.

In the case of an apparatus with multi-nozzles, in addition to reducing the size of the piezoelectric vibrator 14 as above, the distance between two adjacent holes can be shorted because vibrational waves are less likely to affect an adjacent hole. In addition, the distance between two adjacent common grounding electrodes 9 can be shortened because electrostatic repulsion or discharge is less likely to occur, and separate driving becomes unnecessary, which leads to increasing the recording speed. Thus, a construction with multi-nozzles and a compact print head can be easily realized.

Moreover, the combined use of the common grounding electrodes 9 for the piezoelectric vibrator 14 and for the electrostatic field forming device 20 makes the construction of the print head 1 simple, and consequently realizes a compact print head.

[Embodiment 2]

Figure 4:
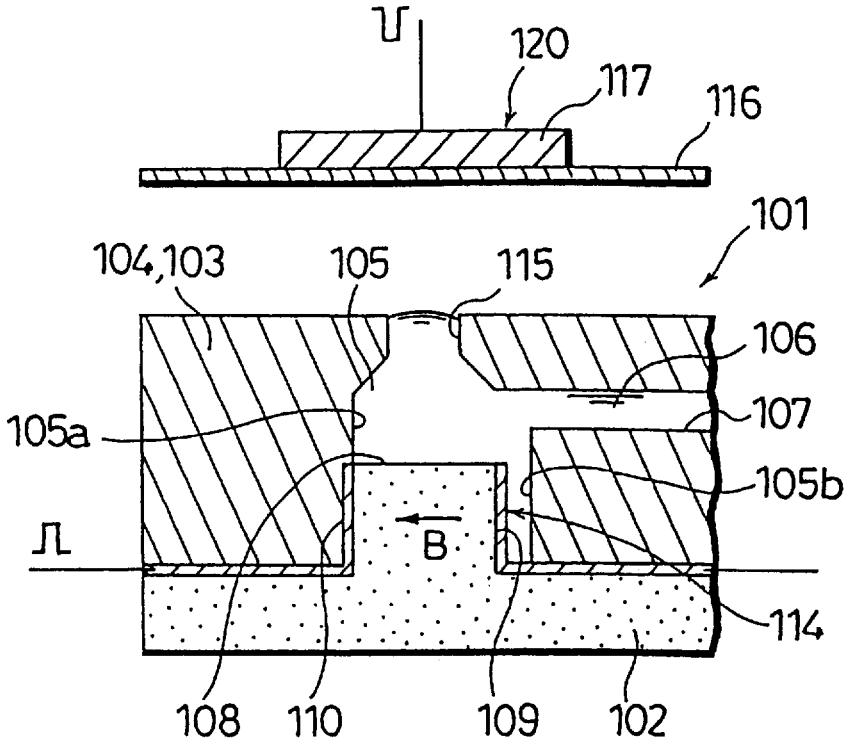
FIG. 4 is a sectional view of the image forming apparatus of another embodiment of this invention in a stopped state.
Figure 5:
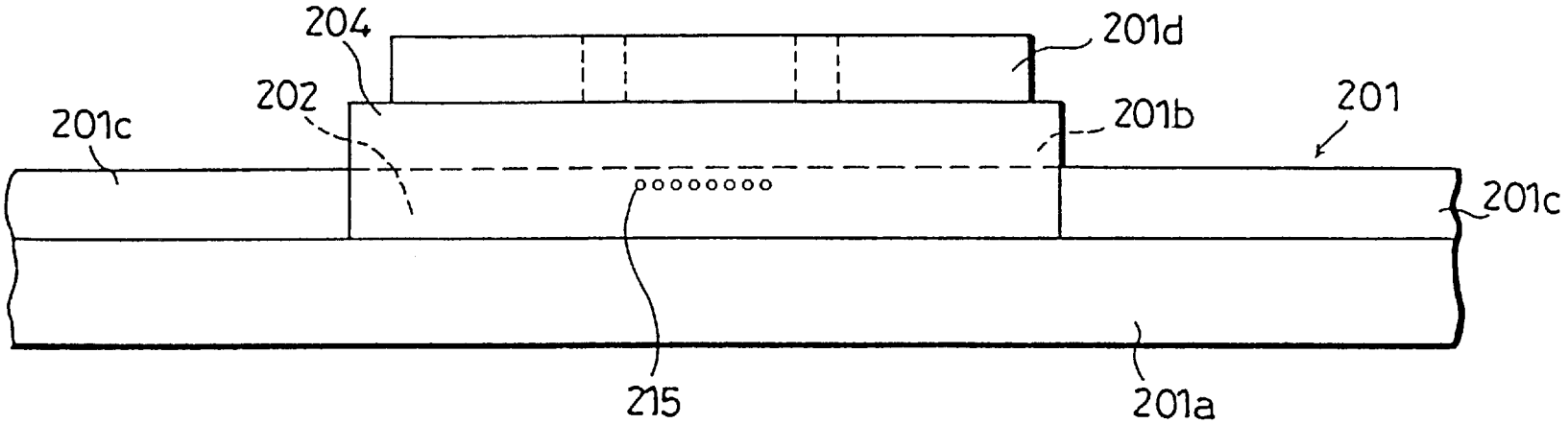
FIG. 5 is a front view of further another embodiment of this invention in a stopped state.

As shown in FIG. 4, the print head 101 of the image forming apparatus of this embodiment comprises an ink supply passage formation member 103, and a nozzle plate 104 both united into a single body, and a piezo plate 102 polarizing in the direction indicated by an arrow B, layered under the united body.

A driving electrode 110 and a common grounding electrode 109 are each provided on the side surfaces of the protruding portion 108 in the piezo plate 102; the driving electrode 110 is in contact with a wall 105*a* of the ink room 105, the common grounding electrode 109 leaving some space from the opposite wall 105*b*.

FIG. 4 additionally shows an inlet 107 for putting ink 106 into the ink room 105, a nozzle hole 115, a piezoelectric vibrator 114, recording paper 116, a counter electrode 117, and an electrostatic field forming device 120.

The effects of this embodiment are fundamentally the same as those of Embodiment 1 except for the difference of the polarizing direction of the piezoelectric vibrator.

[Embodiment 3]

The image forming apparatus of this embodiment is described referring to FIGS. 5 through 9(*f*).

The print head 201 of this image forming apparatus comprises a glass base 201*a* of about 1.5 mm in height, 60 mm in depth, and 40 mm in width, and a piezo plate 202 of about 1 mm in height, 24 mm in depth, and 10 mm in width, layered on the front portion of the glass base 201*a*.

Figure 9:
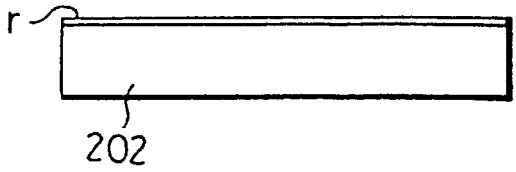
FIG. 9(*a*), FIG. 9(*b*), FIG. 9(*c*), FIG. 9(*d*), FIG. 9(*e*) and FIG. 9(*f*) collectively constitute part of the manufacturing procedure of the same embodiment.
Figure 9:
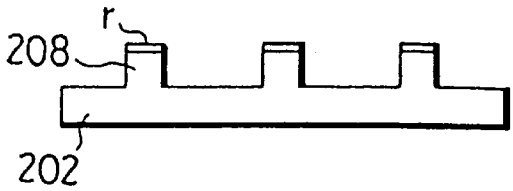
Figure 9:
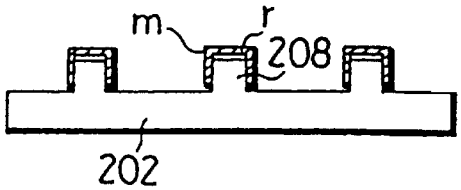
Figure 9:
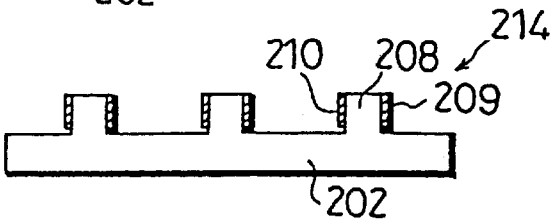
Figure 9:
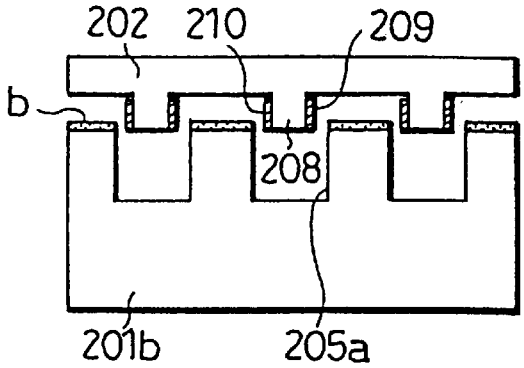
Figure 9:
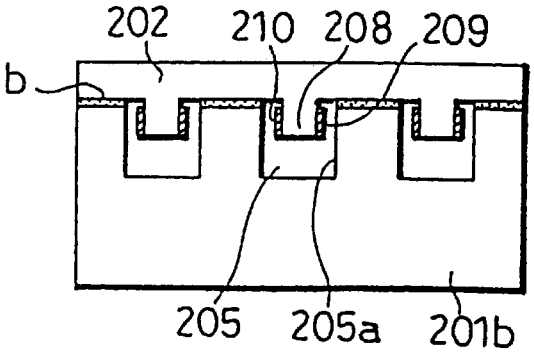

As shown in FIG. 9(*a*)–(*f*), the piezo plate 202 is formed as follows. First, resist r is applied all over the upper surface of the piezo plate 202 as shown in FIG. 9(*a*), a plurality of protruding portions 208 are formed by digging ditches (grooves) in the plate 202 with a dicing saw or the like as shown in FIG. 9(*b*), electrode metal m is made to adhere onto the protruding portions 208 by evaporating, with the piezo plate 202 slant as shown in FIG. 9(*c*), the resist r is exfoliated by etching (etching liquid infiltrates in the direction perpendicular to the figure) in order to form piezoelectric vibrators 214 each having a common grounding electrode 209 and a driving electrode 210 as shown in FIG. 9(*d*), glue b is applied all over the surface of the protruding portions of an upper glass lid 201*b* having a plurality of ditches (grooves) 205*a* corresponding to the ink room 205, the glass lid 201*b* being about 1 mm in height, 9 mm in depth, and 10 mm in width, so that the upper glass lid 201*b* and the piezo plate 202 are combined with the protruding portions 208 of the piezo plate 202 being set into the ditches (grooves) 205*a* of the upper glass lid 201*b* with a space between a bottom surface of each groove 205*a* and a confronting surface of a protruding portion 208 to define an ink room 205 as shown in FIG. 9(*e*), and the glue b is baked to be hardened as shown in FIG. 9(*f*).

The width and the pitch of the protruding portions 208 is about 43 $\mu$m and 83 $\mu$m respectively. Accordingly, the width of each groove between two of the protruding portions is about 40 $\mu$m. The depth of each groove is about 100 $\mu$m.

Figure 6:
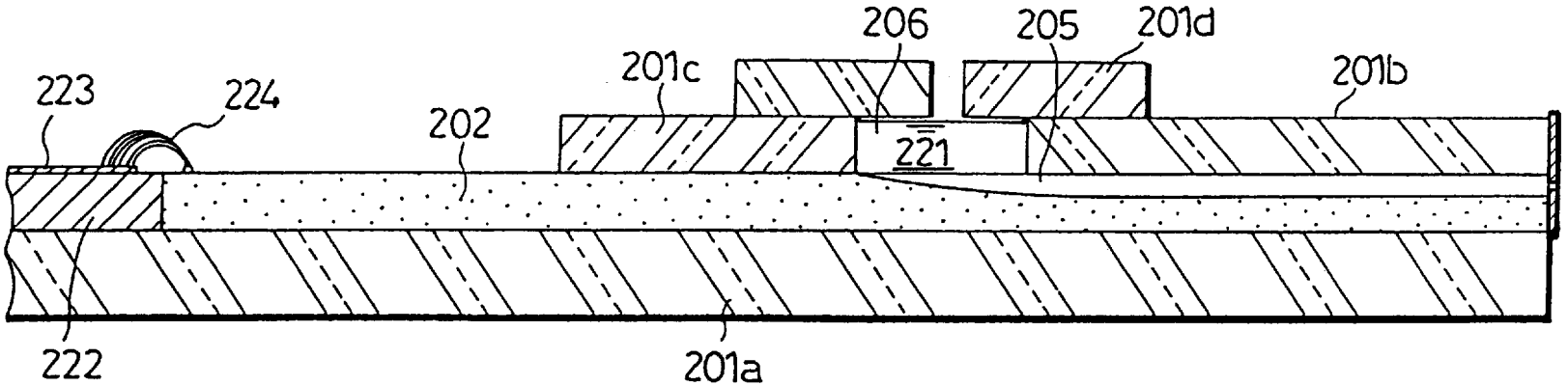
FIG. 6 is a sectional side view of the same embodiment.
Figure 7:
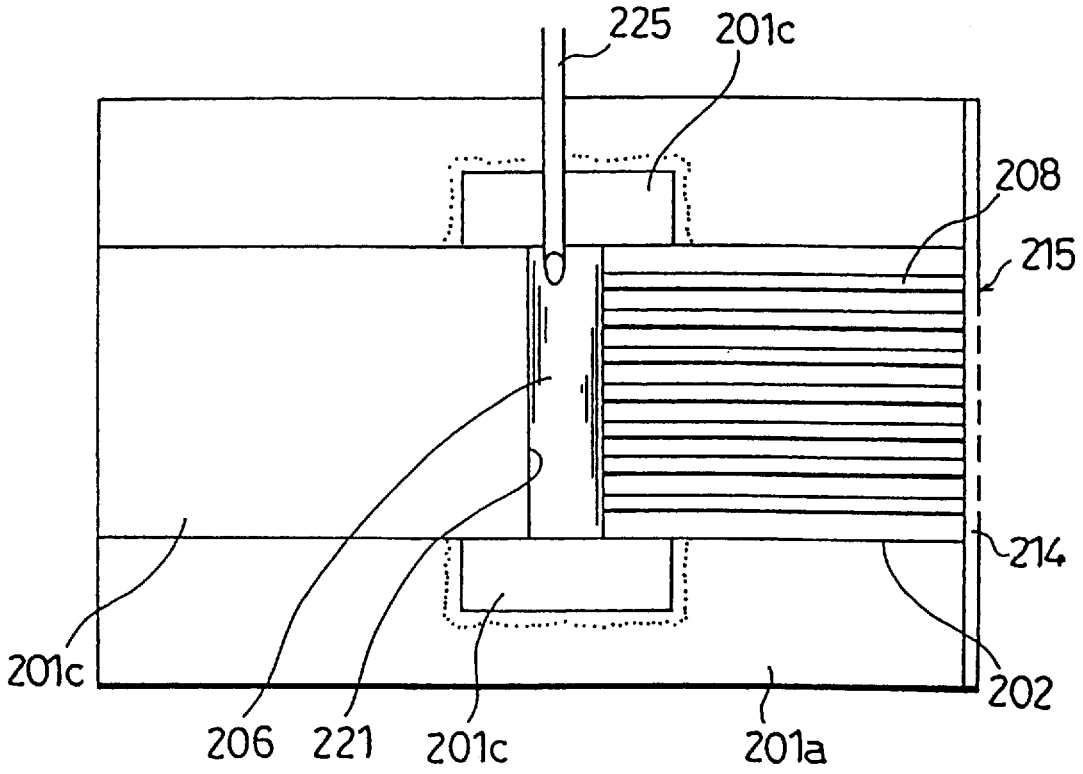
FIG. 7 is a plan view of the same embodiment.
Figure 8:
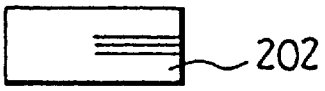
FIG. 8(*a*), FIG. 8(*b*), FIG. 8(*c*), FIG. 8(*d*), FIG. 8(*e*) and FIG. 8(*f*) are plan views of respective units of the same embodiment.
Figure 8:
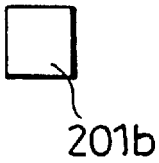
Figure 8:
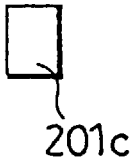
Figure 8:
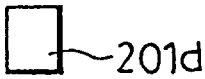
Figure 8:
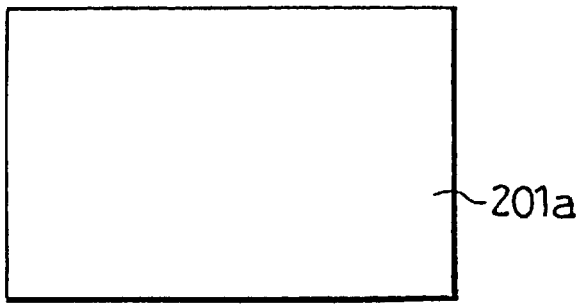
Figure 8:
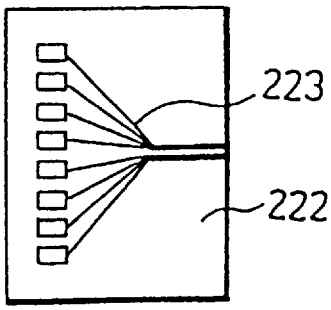

As shown in FIGS. 6 and 7, three glass plates 201*c* of about 1 mm in height, 7 mm in depth, and 10 mm in width are provided behind the upper glass lid 201*b* on the piezo plate 202, so that an ink reservoir 221 connected with the ink room 205 is formed between these glass plates 201*c* and the upper lid 201*b*. This ink reservoir 221 is about 5 mm in depth and 10 mm in width, its upper surface being covered with, for example, a glass ink lid 201*d* of about 1 mm in height, 7 mm in depth, and 9 mm in width. The ink reservoir 221 is supplied with ink 206 from outside through an ink supply tube 225.

In addition to the common grounding electrode 209 and the driving electrode 210, a lead connected therewith is formed by aluminum evaporation on the back of the upper surface of the piezo plate 202, and then as shown in FIG. 6, the lead is connected with the print wiring pattern 223 of the print wiring board 222 mounted on the back of the glass base 201*a* via a wire 224. Each of the driving electrodes 210 is connected to the power source via separate drivers controlled by the control unit so that each driving electrode 210 is powered on and off individually. The above-mentioned print wiring board 222 is about 1 mm in height, 30 mm in depth, and 40 mm in width, consisting of a glass 222*a* and the print wiring pattern 223 provided thereon.

A nozzle plate 204 made of polyimide resin film or the like is adhered on the front of the piezo plate 202 and the glass base 201*a*, the nozzle plate 204 having holes 215 corresponding to each ink room 205.

The remaining constructions including the use of the common grounding electrode 209 as the grounding electrode of the electrostatic field forming device 220 are substantially the same as Embodiments 1 and 2.

In this embodiment, each driving electrode 210 is individually powered on or off by an unillustrated control unit driving each driver according to image data; the piezoelectric vibrator 214 in each ink room 205 is separately driven. As a result, vibrational energy is given to the ink 206 in each ink room 205; an ink meniscus is formed and swells out of each hole 215. Then, the ink 206 is jetted towards the recording paper by the force of the electrostatic field formed between the common grounding electrode 209 and a counter electrode behind unillustrated recording paper. Finally, recordings corresponding to image data are formed on the recording paper.

[Embodiment 4]

Figure 10:
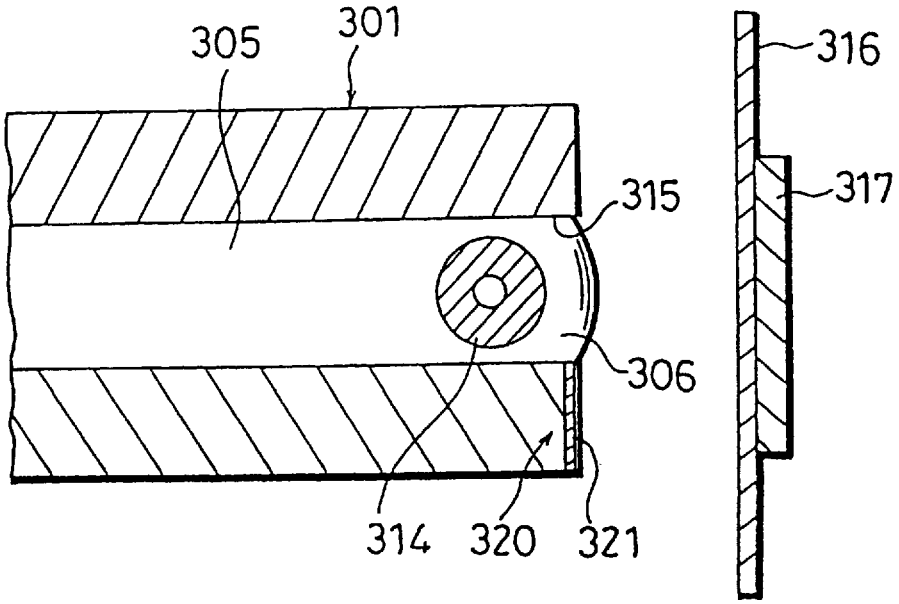
FIG. 10 is a sectional view of another embodiment of this invention.
Figure 11:
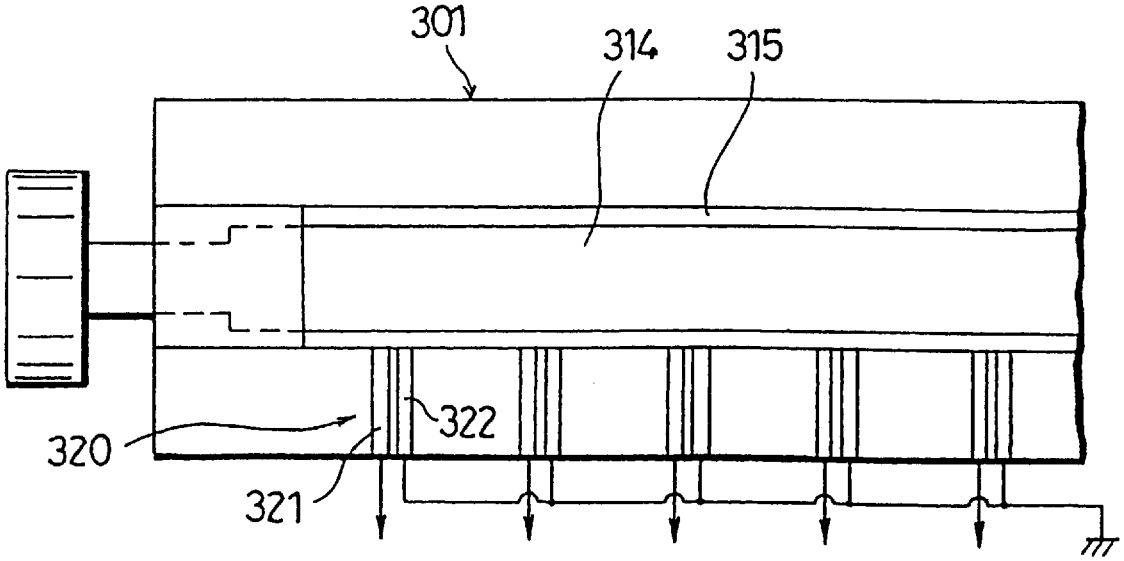
FIG. 11 is a front view of the same embodiment.

A further another embodiment of this invention is described referring to FIGS. 10 and 11.

The print head 301 of this embodiment has a slit 315 in place of nozzle holes 15, 115, or 215, formed in the ink room 305, and a piezo cylinder 314 is also used as a feed roller for feeding the ink 306 to the slit 315. The piezo cylinder 314, the driving electrode 321 used also as a charge injection electrode for the ink 306, and the common grounding electrode 322 constitute a piezoelectric vibrator 320. The common grounding electrode 322 is also used for the electrostatic field forming device including a counter electrode 317 provided via the recording paper 316. When the electric lines of force generated by applying voltage between the driving electrode 321 and the common grounding electrode 322 pass inside the piezo cylinder 314 in the direction of its axis, the passing area of the electric lines of force in the piezo cylinder 314 expands and contracts in a direction perpendicular to its axis. As a result, the ink 306 is partially given vibrational energy and then jetted towards the recording paper, provided that the electrostatic field is formed.

The remaining parts of this embodiment are constructed in the substantially same way as Embodiments 1, 2, and 3 except that printing is controlled by electrostatic energy controlled by each pixel; the effects are the same as those embodiments. Moreover, the use of the slit 315 avoids clogging of the ink 306 and the use of the feed roller made of piezo enhances ink supply ability, thereby leading to increasing both recording frequency and recording speed.

[Embodiment 5]

Figure 12:
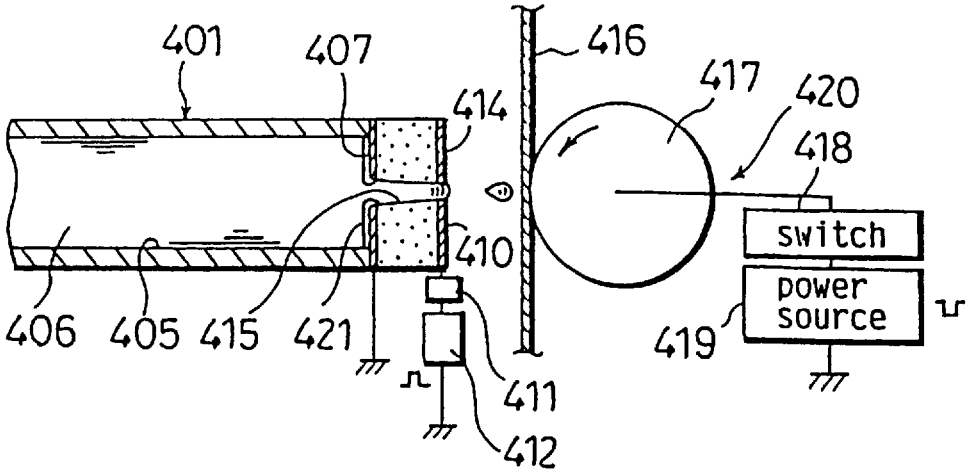
FIG. 12 is a sectional view of another embodiment of this invention.

As shown in FIG. 12, the piezoelectric vibrator 414 of this embodiment is mounted on the head of a nozzle 401 having a hole 415 at the center.

Recording paper 416 and a bias platen roller 417, as the counter electrode of a electrostatic field forming device 420, are positioned in front of the hole 415, the bias platen roller 417 being connected with a power source 419 via a switch print pattern 418.

A protective coat 421 is provided between the common grounding electrode 407 of the piezoelectric vibrator 414 and an ink room 405 inside the nozzle 401, being in contact with both of them. A driving electrode 410, connected with a power source 412 via a driver 411, is formed at the head of the nozzle 401. Ink 406 is held in the ink room 405.

The remaining parts of the construction and effects of this embodiment are substantially the same as those of Embodiments 1 through 4.

Each of the ink rooms 5, 105, 205, 305, and 405 may be constructed by using a structure having a number of fine pores.

[Embodiment 6]

Figure 13:
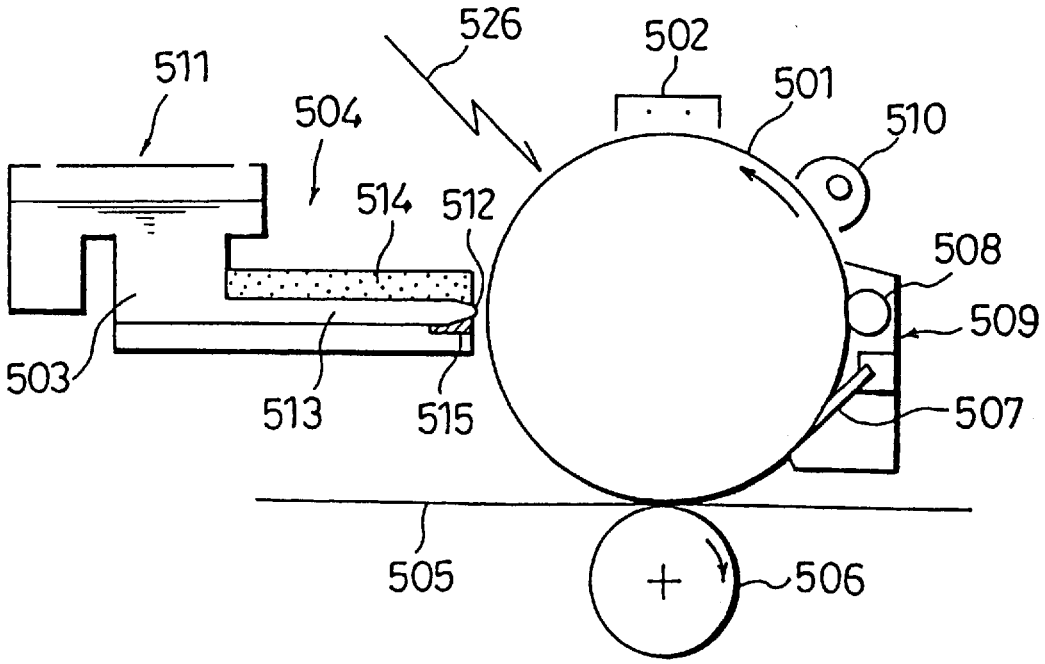
FIG. 13 is an overall constructional view of the image forming apparatus of another embodiment of this invention.

As shown in FIG. 13, the image forming apparatus of this embodiment comprises a cylindrical photosensitive body 501, a charger 502 to charge the photosensitive body 501, a multi-nozzle head 504 to supply ink 503 to the surface of the photosensitive body 501, a pressure transfer roller 506 to press recording paper 505 onto the surface of the body 501, a cleaning unit 509 consisting of a cleaning blade 507 and a cleaning roller 508 to clean the surface of the body 501, and an eraser lamp 510 to get rid of charges remaining on the body 501.

The multi-nozzle head 504 has a plurality of ink outlets 512 formed at a certain interval in the axial direction of the photosensitive body 501, an ink reservoir 511 formed behind the head 504 to supply the same amount of ink as that used for development, and an ink passage 513 formed therebetween. A piezoelectric body 514 to vibrate the ink 503 is provided in the ink passage 513, and an electrode 515 as charge injecting device to inject charges into the ink 503 is provided near the ink outlets 512. The electrode 515 is applied about 10V to 500V bias by an unillustrated bias applying device. Such a range of voltage brings out effects of charge injection without causing the deterioration of the quality of the ink 503 or a raise of power cost.

In case that ink with high resistance of about $10^2$ Ωcm $10^5$ Ωcm is used as the ink 503, the electrode 515 becomes dispensable because the ink 503 inside the multi-nozzle head 504 gets charges by friction with the walls inside the nozzle, which is caused by capillary phenomenon. If the ink is not charged by the friction, polarized charges can be produced by electrostatic induction when the electrostatic field is applied to the ink. As a result, the electrostatic field affects the charges, thereby causing a force to help jet the ink. However, producing a charge injection electrode is still effective in reducing electrostatic energy to jet ink with high resistance.

Figure 14:
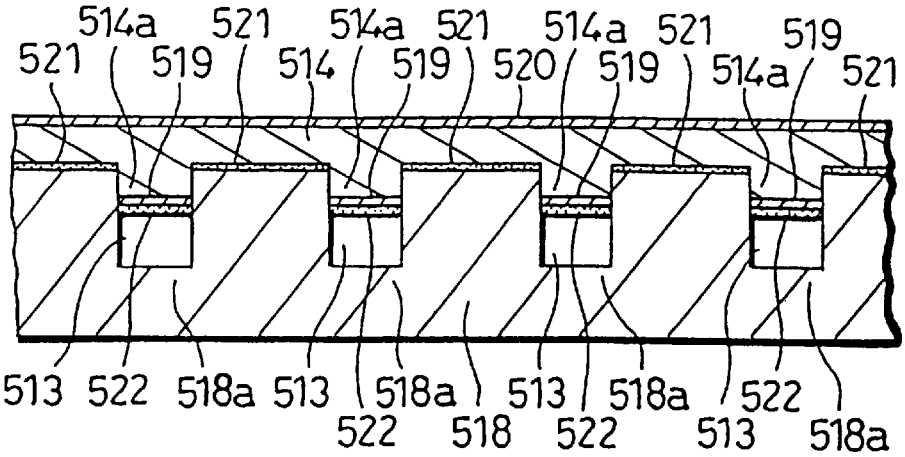
FIG. 14 is a sectional view of the ink passage in the multi-nozzle head of the same embodiment.

As shown in FIG. 14, the multi-nozzle head 504 consists of a piezoelectric body 514 having protruding portions 514*a* . . . and a supporting member 518 having hollowed portions 518*a* . . . both portions engaging each other. There is some space between the bottom surface of each hollowed portion 518*a* and the confronting surface of the associated protruding portion of 514*a*, which is used as an ink passage 513. An electrode 519 is formed at the upper surface of the hollowed portions, while a common electrode 520 is formed at the surface of the other side. Pulse voltage is applied between the electrodes 519 and 520 from an unillustrated power source. The piezoelectric body 514 and the supporting member 518 are combined with each other with glue 521. The surface of the electrode 519 is covered with a dielectric protective layer 522. The electrode 519 can be also used as an electrode for charge injection, the electrode 515 being omitted. If the resistance of the ink 503 is large, the protective layer 522 becomes dispensable.

Figure 15:
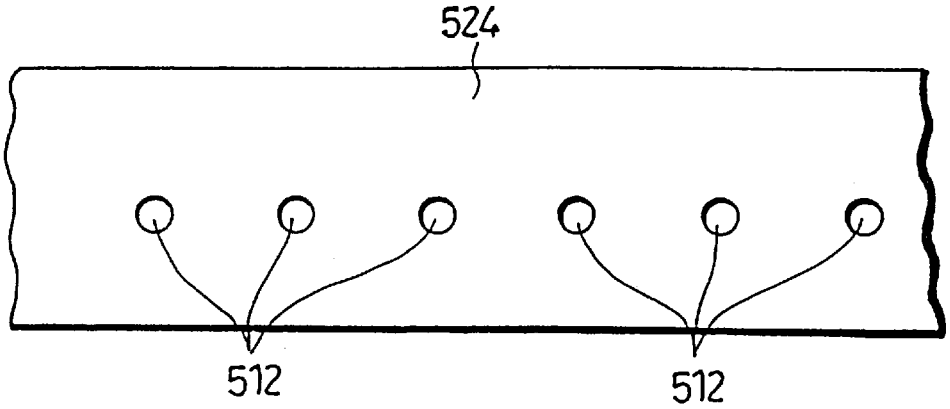
FIG. 15 is a front view of the nozzle plate in the multi-nozzle head of the same embodiment.
Figure 16:
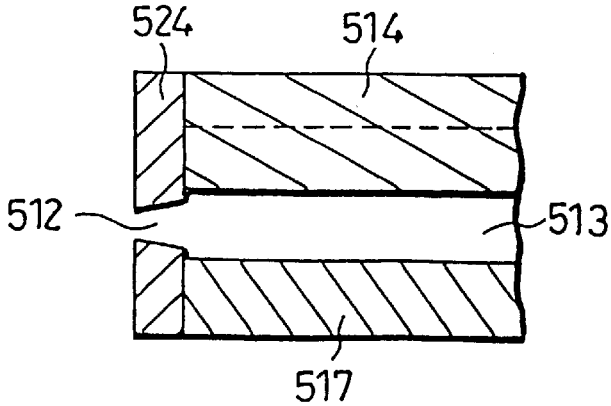
FIG. 16 is a sectional view of the vicinity of an ink outlet in the multi-nozzle head of the same embodiment.

As shown in FIGS. 15 and 16, a nozzle plate 524 having a number of tapered ink outlets 512 connected with the ink passage 513 is provided at the surface opposite to the photosensitive body 501. The nozzle plate 524 is made from polyimide having a thickness of 100 μm, with holes formed by an excimer laser.

The distance between the ink outlets 512 and the photosensitive body 501 is set to be in the range of about 0.2 mm to 2 mm; the ink 503 is kept away from the photosensitive body 501 without difficulty and the potential of electrostatic latent images, required for applying electrostatic attracting force to the charged ink 503, can be lowered.

Although the pitch of the ink outlets 512 is restricted by machining accuracy and the resolution of images formed, it is desirable to be in the range of about 50 μm to 300 μm. Also, the desirable distance between the electrodes 519 and 520 is in the range of about 10 μm to 5 mm from the viewpoint of strength and cost. In such a case, voltage in the range of about 10V to 500V can be applied between the electrode 519 and the common electrode 520, or 1 kHz to 10 MHz AC voltage can be added to the voltage.

The following is a description of the operation of the above-mentioned image forming apparatus. The photosensitive body 501 is rotated by an unillustrated rotating device in the direction indicated by the arrow therein in FIG. 13. After being evenly charged at about 300V to 1 kV by the charger 502, the surface of the photosensitive body 501 is radiated with light 526 from a light head using an unillustrated liquid crystal display (LCD), a laser beam exposure head, a light emitting diode (LED), PLZT, or the like. As a result, electrostatic latent images corresponding to images to be recorded are formed on the surface of the photosensitive body 501.

On the other hand, the ink passage 513 is supplied with the ink 503 from the ink reservoir 511, at the same time, the piezoelectric body 514 vibrating the protruding portions 514*a* . . . in thickness vibration mode with pulse voltage applied between the electrode 519 and the common electrode 520. Accordingly, the volume of the ink passage 513 repeatedly expands and contracts, and as a consequence, the ink 503 vibrates and then repeats going in/out through the ink outlets 512. This means that ink near the outlets 512 is not jetted therefrom but reciprocated in the ink running direction of the ink passage 513. At this point, the ink near the outlets 512 is charged the polarity opposite to that of the electrostatic latent images of the photosensitive body 501 by biases applied on the electrode 515. Therefore, the ink near the outlets 512 is, when moved towards the outside of the outlets 512 by vibration, jetted by both the attracting force of the charges of the electrostatic latent images and by vibrational inertia force, finally to adhere on the electrostatic latent images formed on the surface of the photosensitive body. This ink is transferred onto the recording paper 505.

The above-mentioned operation is continued in accordance with the rotation of the photosensitive body 501 and images are transferred onto the recording paper 505. The ink and charges remaining on the surface of the body 501 are gotten rid of by the cleaning unit 509 and the eraser lamp 510 respectively.

Thus, the ink 503 adheres onto the surface of the photosensitive body 501 not only by the vibration of the piezoelectric body 514 but also by electrostatic attracting force, so that bias voltage for development can be reduced, as compared with the case where only the electrostatic attracting force is used. Accordingly, product cost can be reduced. Moreover, substantially any kinds of ink can be used to obtain images of higher quality. Furthermore, the wide range setting of the distance between the photosensitive body 501 and the multi-nozzle head 504 serves to reduce ununiformity of image density.

[Embodiment 7]

Figure 17:
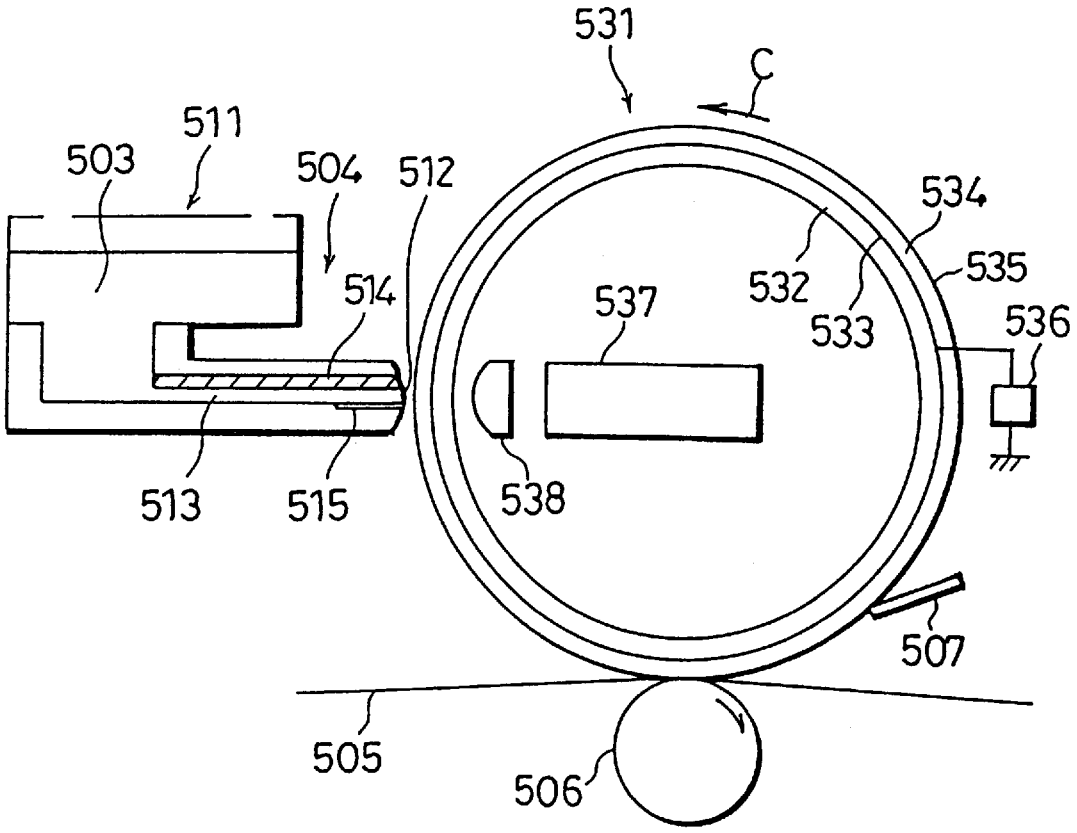
FIG. 17 is an overall constructional view of the image forming apparatus of another embodiment.

In this embodiment, light is exposed from inside of a photosensitive body 531 as shown in FIG. 17.

The photosensitive body 531, which is rotated in the direction indicated by an arrow C by an unillustrated driving apparatus, comprises a cylindrical transparent body 532, a thin transparent conductive layer 533 covering the outer surface thereof, a photoconductive layer 534 covering the surface thereof, and a thin ink repellent overcoat layer 535 further covering the surface thereof.

The transparent conductive layer 533 is electrically connected with the cathode terminal of a bias attraction power source 536. Provided inside the photosensitive body 531 are a non-rotatable light writing head 537 for exposing the light conductive layer 534 by radiating light thereto through the transparent body 532 and the transparent conductive body 533, and an optical lens 538. Provided outside the body 531 are a multi-nozzle head 504 to supply ink 503 to positions on the surface of the ink repellent overcoat layer 535, corresponding to positions where light is radiated by the light writing head 537, a rotatable pressure transfer roller 506 to press recording paper 505 onto the surface of the photosensitive body 531, and a cleaning blade 507 to clean the surface thereof. An electrode 515 to charge the ink 503 is provided near the ink outlets 512 of the multi-nozzle head 504. The exposure position of the light writing head 537 faces the outlets 512. The same constructional components as those in FIG. 13 are assigned the same numbers, and detailed description of the construction is omitted.

The light corresponding to image information eradiated from the light writing head 537 passes through the optical lens 538, the transparent body 532, and the transparent conductive layer 533 finally to come into the photoconductive layer 534. As a result, pair of positive photo carriers and negative photo carriers are generated on the photoconductive layer 534. The electrostatic field is formed between the transparent conductive layer 533 applied negative biases by the bias attraction power source 536 and the electrode 515 applied positive biases, and as a consequence, the positive photo carriers are attracted towards the transparent conductive layer 533, so that the negative photo carriers remain on the surface of the photoconductive body 531 as electrostatic latent images, and the potential of portions on the surface of the body 531 onto which the light is eradiated become substantially equal to that of the transparent conductive layer 533. Consequently, a charge injection area is formed between the light writing head 537 and the electrode 515; the ink 503 being charged. On the other hand, the ink passage 513 is supplied with ink 503 from the ink reservoir 511 behind thereof. The protruding portions of the piezoelectric body 514 are displaced in thickness vibration mode by pulse voltage applied between the electrodes. As a result, the volume of the ink passage 513 repeatedly expands and contracts thereby vibrating the ink 503 that, as a consequence, repeats going in and out through the outlets 512. This means that ink near the outlets 512 is not jetted therefrom but reciprocated in the ink running direction of the ink passage 513. Accordingly, the ink near the outlets 512 is, when moved towards the outside of the outlets 512 by vibration, jetted by both attracting force of the charges of the electrostatic latent images and by vibrational inertia force, finally to adhere onto electrostatic latent images formed on the surface of the photosensitive body 531. This ink is transferred onto the recording paper 505. The above-mentioned operation is continued in accordance with the rotation of the photosensitive body 531, and images are recorded on the recording paper 535. The ink remaining on the surface of the body 531 is gotten rid of by the cleaning blade 507. Thus, this embodiment has an electrostatic latent image generation mechanism to form and develop such images at the same time, the mechanism differing from that of Embodiment 6 shown in FIG. 13.

Figure 18:
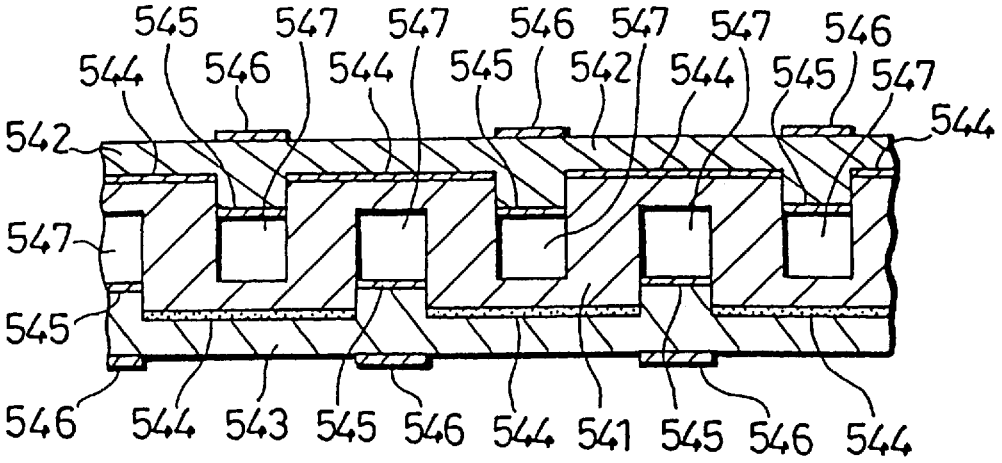
FIG. 18 is a sectional view of the ink passage in the multi-nozzle head of the same embodiment.

Although the hollowed portions are formed only on one surface of the supporting member 518 in Embodiments 6 and 7, they may be formed on both surfaces of the supporting member 541, engaged with the protruding portions of piezoelectric bodies 542 and 543, and applied with glue 544 as shown in FIG. 18. In this construction, the ink in the ink passage 547 is vibrated by providing electrodes 545 connected with each other onto the upper surface of the protruding portions, and providing common electrodes 546 on the opposite surface of the protruding portions. According to such a construction, the density of the ink outlets can be doubled, thereby improving the resolution. This can be applied to the print head 201 in Embodiment 3.

Figure 19:
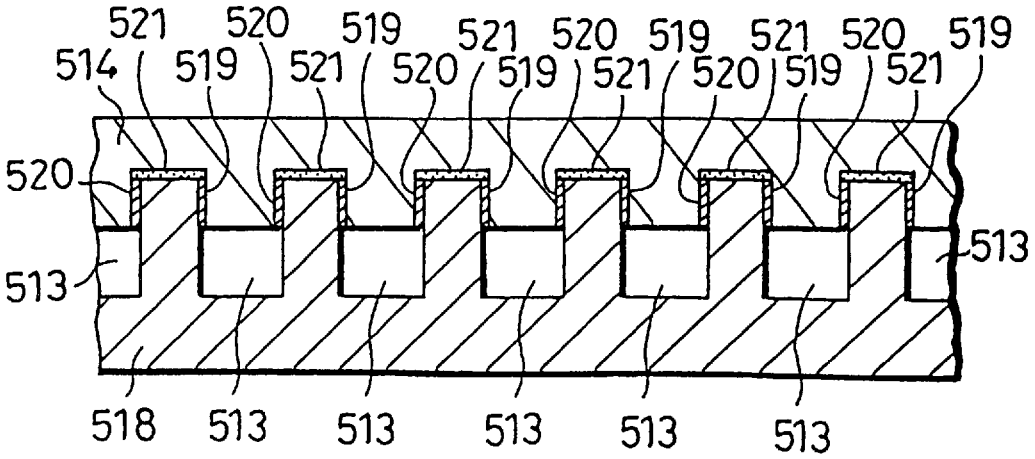
FIG. 19 is a sectional view of the ink passage in the multi-nozzle head of the same embodiment.

Although the electrode 519 and the common electrode 520 are respectively formed on the upper surface of each protruding portion of the piezoelectric body 514 and the opposite side thereto so that the protruding portions is vibrated in thickness vibration mode, both the electrodes 519 and 520 may be provided on both surfaces of each protruding portion as shown in FIG. 19 thereby vibrating the protruding portions in length vibration mode like Embodiment 3. According to this construction, the distance between the electrode 519 and the common electrode 520 can be shortened, thereby reducing both the applying voltage to vibrate the piezoelectric body 514 and the product cost of the apparatus.

The image forming apparatuses of all the embodiments mentioned hereinbefore can employ high viscosity (1 cp to 100 cp) ink which is difficult to jet in conventional apparatuses because of the large surface tension, or high resistance ($10^2\Omega$ to $10^{15}$ $\Omega$cm) ink which is difficult to jet only by electrostatic force such as pigment dispersion ink.

The following can be used as organic solvent for such pigment dispersion ink: alcohols such as methyl alcohol, ethyl alcohol, n-propyl alcohol, iso-propyl alcohol, n-butyl alcohol, sec-butyl alcohol, tert-butyl alcohol, iso-butyl alcohol, furfuryl alcohol, and tetrahydrofurfuryl alcohol; ketone or ketone-alcohols such as acetone, methyl ethyl ketone, and diacetone alcohol; alkanolamines such as monoethanolamine, diethanolamine, and triethanolamine; amides such as dimethylformamide and dimethylacetonamide; ethers such as tetrahydrofuran and dioxane; esters such as ethyl acetate, methyl benzoic, ethyl lactate, and ethylene carbonate; polyhydric alcohols such as ethylene glycol, diethylene glycol, triethylene glycol, propylene glycol, tetraethylene glycol, polyethylene glycol, glycerine, 1,2,6-hexanetriole, and thiodiglycol; lower alkylmono ether induced by alkylene glycols such as ethylene glycol monomethyl ether, ethylene glycol monoethyl ether, diethylene glycol monomethyl ether, diethylene glycol menoethyl ether, propylene glycol monomethyl ether, propylene glycol monoethyl ether, diethylene glycol dimethyl ether, and diethylene glycol diethyl ether; diethers; and nitrogen ring compounds such as pyrrolidone.

It is preferable to utilize polyhydric alcohols or alkyl ethers induced by polyhydric alcohol, and more preferable to utilize polyhydric alcohols such as diethylene glycol for further improvement of the pigment dispersion ink properties. Generally, the content of these ingredients ranges 10% to 90% by weight; however, it is desirable to add 20% to 70% of them in order to maintain less temperature dependency of the material value. The content of water generally ranges 5% to 80% in weight, and more preferably 10% to 70%, and most preferably 20% to 70%.

Any organic or inorganic pigments including conventionally used ones can be utilized as the pigment for pigment dispersion ink.

The dispersed particles of these pigments have diameters ranging a few millimicron to a few micron, and it is more desirable to utilize water paste pigment immediately after the production process. The preferable content of the pigment in the pigment dispersion ink ranges 3% to 30% by weight, when influence on tinting strength and viscosity are expected.

Organic pigments are chemically classified as follows: azo series, phthalocyanine series, quinacridone series, anthraquinone series, dioxazine series, indigo series, thioindigo series, perynone series, perylene series, isoindolenone series, and the like.

Well known insoluble pigments are Hansa Yellow, Benzine Yellow, Indathrene Orange, Para Red, Thioindigo Red, Toluindigo Red, both Iudustan Bordeaux and Toluidine Maroon for violet, Indanthrene Blue RS, Phthalocyanine Blue, Phthalocyanine Green and the like.

Well known soluble pigments are auramine and Fast Light Yellow 3G for yellow; Persian Orange and Pigment Scarlet 3G for orange; Lithol Red, Lake Red, Eosin, and Rhodamine for red; Methyl Violet for violet; Victoria Blue and Peacock Blue for blue; and Acid Green and Malachite Green for green.

Inorganic pigments are chemically classified as follows: titanium oxides, lead series, cadmium series, iron oxide series, carbon black, and the like. However, inorganic pigments are generally classified in colors: white, yellow, red, violet, blue, green, black, and others.

White pigments include zinc white (ZnO), lithopone ($BaSO_4$+ZnS), titanium white (titanium dioxide, $TiO_2$), white lead ($2PbCO_3$-$Pb(OH)_2$), barite ($BaSO_4$), chalk ($CaCO_3$), and clay (kaolin, $Al_2O_3$-$2SiO_2$-$2H_2O$).

Yellow pigments include chrome yellow ($PbCrO_4$), zinc yellow ($ZnCrO_4$), cadmium yellow (CdS), Antimony Yellow (Naples Yellow, $Pb(SbO_3)_2$), ochre ($Fe_2O_3$-$xAl_2O_3$-$ySiO_2$), and Hydrated Yellow, (Mars Yellow, Ferrite Yellow, $Fe_2O_3nH_2O$).

Red pigments are red iron oxide ($Fe_2O_3$), red lead ($Pb_3O_4$), vermilion (HgS), and cadmium red (selenium red, CdS-CdSe).

Violet pigments include Mars Violet ($Fe_2O_3$), Manganese Violet (Neuremberg, $(NH_4)Mn(PO_4)_2$), and Cobalt Violet, ($CO_3(PO_4)_2$—$Co_3(AsO_4)_2$).

Blue pigments include Ultramarine (alminosilicate containing sulfur), Milori Blue (Berlin Blue, $Fe(NH_4)$ [$Fe(CN)_6$], Fek [$Fe(CN)_6$]), and Cobalt Blue ($CaO$-$xAl_2O_3$).

Green pigments include Chromium Green (a mixture of Chrome Yellow and Milori Blue with Barite added thereto), chromium oxide ($Cr_2O_3$), Emerald Green ($Cu(CH_3CO_2)_2$-$3CU(AsO_3)_2$), Cobalt Green (CoO-1OZnO), and natural green ($CuCO_3$-$Cu(OH)_2$).

Black pigments are usually called carbon black and include channel black, furnace black, acetylene black, anthracene black, lamp black, pine tar and graphite plumbago.

Dispersion agents utilized for the pigment dispersion ink are: nonionic surfactants such as polyoxyethylene alkyl ether, polyoxyalkyl phenyl ether, polyoxyethylene fatty acid ester, polyoxyethylene polyoxypropylene block copolymer; anionic surfactants such as higher alcohol ester sulfate, ester sulfate of polyoxyethylene adduct, and alkylsulfate of fatty acid alkylamide; and cationic surfactants such as higher alkylammonium halide.

The amount of these surfactants added to the pigment dispersion ink is generally less than 20% by weight thereof, and preferably less than 15% by weight.

Also, a resin is added as solvent to the pigment dispersion ink in order to further improve the dispersion of the recording liquid as well as the adhesion to the recording media. More than one natural or synthetic resin among almost all soluble resins as follows are utilized: polymethacrylate resin, polyacrylate resin, acrylic ester-acrylic acid copolymer resin, vinyl resins such as polyvinyl pyrrolidone and polyvinyl butyral resin, hydrocarbon resin, phenol resin, xylene resin, ketone resin, alkyd resin, polyamide resin, polyester resin, maleic resin, cellulosic resin, rosin resin, gelatin, casein, and shellac.

The amount of these resins added to the pigment dispersion ink generally ranges 0.2% to 30% by weight, and preferably, 0.5% to 10%. When less than 0.2 wt/% of the resin is added to the pigment, not only pigment dispersion stability but also the adhesion to recording paper deteriorate.

In addition, other agents such as anti-corrosion, surfactants, lubricant, and perfume can be added to the pigment dispersion ink.

Also, the pigment dispersion ink can be produced through known methods: the above ingredients are kneaded and dispersed by machines such as a homomixer, a ball mill, a homogenizer, a sand mill, and a roll mill.

The above-mentioned pigment dispersion ink has advantages of higher recording density, light stability, water resisting property, and adhesion to the recording paper.

An image forming apparatus is constructed according to the above-mentioned embodiments by using ink (No. 1 through 4) having the composition shown in FIG. 20, and as a consequence, satisfactory images were recorded.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An ink jet recording apparatus for forming an ink image onto an ink carrier, comprising:

a first member having a plurality of hollow portions, each of said hollow portions having a bottom surface;

a second member, said second member having a plurality of portions including a piezoelectric material, each one of said plurality of portions of said second member corresponding to a respective one of said hollow portions, said second member being provided adjacent to said first member so that each respective one of said portions of said second member confronts a respective one of said hollow portions to define a space between a surface of each respective one of said portions of said second member and the bottom surface of each respective confronting hollow portion, each space defining an ink room;

an ink supply connected with each of said ink rooms to supply ink into said ink rooms;

a plurality of electrodes provided on said portions of said second member, respectively; and a driver connected with each of said electrodes to apply a voltage to each respective one of said portions of said second member, wherein each respective one of said portions of said second member is polarized in a direction parallel to the direction of an electric field induced by the voltage applied by said driver.

2. The ink jet recording apparatus as claimed in claim 1, further comprising:

a plurality of protection members which cover said portions of said second member, respectively.

3. The ink jet recording apparatus as claimed in claim 1, wherein each of said plurality of portions of said second member is a protruding portion, and wherein protruding portions in each adjacent pair of protruding portions are separated from each other by a respective one of a plurality of grooves formed on a surface of said second member.

4. The ink jet recording apparatus as claimed in claim 2, wherein said plurality of protection members are provided on said electrodes, respectively.

5. An ink jet head for jetting ink to an ink carrier, comprising:

a first member having a plurality of hollow portions, each of said hollow portions having a bottom surface; and a second member, having a plurality of portions, each respective one of said portions of said second member corresponding to a respective one of said hollow portions, each of said portions of said second member including a piezoelectric material which is sandwiched by a first electrode and a second electrode, said second member being provided adjacent to said first member so that each respective one of said portions of said second member confronts a respective one of said hollow portions to define a space between a surface of each respective one of said portions of said second member and the bottom surface of each respective confronting hollow portion, each space defining an ink room, each respective one of said portions of said second member being polarized in a direction parallel to an electric field formed between the respective first electrode and the respective second electrode.

6. The ink jet head as claimed in claim 5, further comprising:

a plurality of protection members which cover said portions of said second member, respectively.

7. The ink jet head as claimed in claim 5, wherein each of said plurality of portions of said second member is a protruding portion, and wherein protruding portions in each adjacent pair of protruding portions are separated from each other by a respective one of a plurality of grooves formed on a surface of said second member.

8. The ink jet head as claimed in claim 6, wherein said plurality of protection members are provided on said first electrodes, respectively.

9. An ink jet recording apparatus for forming an ink image onto an ink carrier, comprising:

a first member having a plurality of hollow portions on a first surface thereof;

a second member, said second member having a second surface and a third surface opposed to said second surface, said second member having a plurality of portions including a piezoelectric material, each respective one of said plurality of portions of said second member being defined on said second surface and corresponding to a respective one of said hollow portions, said second surface being provided on said first surface so that each respective one of said portions of said second member confronts a respective one of said hollow portions to define a space between a surface of each respective one of said portions of said second member and a bottom surface of a respective confronting hollow portion, each of said spaces defining an ink room;

a plurality of first electrodes provided on said second surface corresponding to said portions of said second member, respectively;

a plurality of second electrodes provided on said third surface corresponding to said portions of said second member, respectively;

an ink supply connected with each of said ink rooms to supply ink into said ink rooms, and a driver connected with each of said first electrodes and each of said second electrodes to apply a voltage for driving each of said portions of said second member, the piezoelectric material of each respective one of said portions of said second member being polarized in a direction parallel to an electric field formed between the respective one of said first electrodes and the respective one of said second electrodes by said driver.

10. The ink jet recording apparatus as claimed in claim 9, wherein said second electrodes are connected with each other.

11. The ink jet recording apparatus as claimed in claim 9, wherein each of said plurality of portions of said second member is a protruding portion, and wherein protruding portions in each adjacent pair of protruding portions are separated from each other by a respective one of a plurality of grooves formed on said second surface.

12. An ink jet head for jetting ink onto an ink carrier, comprising:

a first member having a plurality of hollow portions on a first surface thereof;

a second member having a second surface and a third surface opposed to said second surface, said second member having a plurality of portions including a piezoelectric material, each respective one of said plurality of portions of said second member being defined on said second surface corresponding to a respective one of said hollow portions, respectively, said second surface being provided on said first surface so that each respective one of said portions of said second member confronts a respective one of said hollow portions to define a space between a surface of each respective one of said portions of said second member and a bottom surface of each confronting hollow portion, each of said spaces defining an ink room;

a plurality of first electrodes provided on said second surface corresponding to said portions of said second member, respectively; and a plurality of second electrodes provided on said third surface corresponding to said portions of said second member, respectively, each respective one of said portions of said second member being polarized in a direction parallel to an electric field formed between the respective one of said first electrodes and the respective one of said second electrodes.

13. The ink jet head as claimed in claim 12, wherein said second electrodes are connected with each other.

14. The ink jet head as claimed in claim 12, wherein each of said plurality of portions of said second member is a protruding portion, and wherein protruding portions in each adjacent pair of protruding portions are separated from each other by a respective one of a plurality of grooves formed on said second surface.

15. An ink jet recording apparatus for forming an ink image onto an ink carrier, comprising:

a first member having a plurality of hollow portions;

a second member, said second member having a plurality of portions including a piezoelectric material, each respective one of said plurality of portions of said second member corresponding to a respective one of said hollow portions, said second member being provided on said first member so that each respective one of said portions of said second member confronts a respective one of said hollow portions to define a space between a surface of each respective one of said portions of said second member and a bottom surface of a respective confronting hollow portion, each of said spaces defining an ink room;

an ink supply connected with each of said ink rooms to supply ink into said ink rooms;

a plurality of protection members which cover said portions of said second member, respectively;

a plurality of electrodes provided on said portions of said second member, respectively; and a driver connected with each of said electrodes to apply a voltage for driving each of said modulating portions.

16. The ink jet recording apparatus as claimed in claim 15, wherein each of said plurality of portions of said second member is a protruding portion, and wherein protruding portions in each adjacent pair of protruding portions are separated from each other by a respective one of a plurality of grooves formed on a surface of said second member.

17. The ink jet recording apparatus as claimed in claim 15, wherein said plurality of protection members are provided on said electrodes, respectively.

18. An ink jet head for jetting ink onto an ink carrier, comprising:

a first member having a plurality of hollow portions;

a second member, said second member having a plurality of portions including a piezoelectric material, each respective one of said plurality of portions of said second member corresponding to a respective one of said hollow portions, said second member being provided on said first member so that each respective one of said portions of said second member confronts a respective one of said hollow portions to define a space between a surface of each respective one of said portions of said second member and a bottom surface of a respective confronting hollow portion, each of said spaces defining an ink room;

a plurality of protection members which cover said portions of said second member, respectively; and a plurality of electrodes provided on said portions of said second member, respectively.

19. The ink jet head as claimed in claim 18, wherein each of said plurality of portions of said second member is a protruding portion, and wherein protruding portions in each adjacent pair of protruding portions are separated from each other by a respective one of a plurality of grooves formed on a surface of said second member.

20. The ink jet head as claimed in claim 18, wherein said plurality of protection members are provided on said electrodes, respectively.

21. An ink jet recording apparatus for forming an ink image onto an ink carrier, comprising:

a first member having a plurality of first portions, each first portion having a bottom area spaced from a first surface of said first member;

a second member, said second member having a plurality of second portions with each respective one of said second portions corresponding to a respective one of said first portions, each second portion having a top area which protrudes from a second surface of said second member, each second portion including a piezoelectric material which is polarized in a direction parallel to an electrical field generated by an input signal, said second surface being in contact with said first surface so that the top area of each respective one of said second portions confronts a respective one of said first portions, a space between the top area of each respective one of said second portions and the bottom area of a respective one of said first portions defining an ink room; and a driver which is connected with said second portions to apply the input signal.

22. The ink jet recording apparatus as claimed in claim 21, wherein each of said plurality of portions of said second member is a protrusion, and wherein protrusions in each adjacent pair of protrusions are separated from each other by a respective one of a plurality of grooves formed on said second member.

23. The ink jet recording apparatus as claimed in claim 22, wherein each groove has a bottom surface which defines said second surface.

24. The ink let recording apparatus as claimed in claim 21, wherein each respective one of said second portions extends into the respective one of said first portions.

25. The ink jet recording apparatus as claimed in claim 21, wherein each first portion of said first member is a groove formed in said first surface of said first member.

26. The ink jet recording apparatus as claimed in claim 21, wherein a plurality of first electrodes are provided on the top areas of said second portions, respectively, and a second electrode is provided on a third surface of said second member opposing to said second surface.

27. The ink jet recording apparatus as claimed in claim 21, wherein said second surface is in contact with said first surface through a glue.

28. The ink jet recording apparatus as claimed in claim 21, wherein the piezoelectric material of each second portion vibrates in a thickness vibration mode in response to the electrical field.

29. An ink jet head for jetting ink to an ink carrier, comprising:

a first member having a plurality of first portions, each first portion having a bottom area spaced from a first surface of said first member; and a second member, said second plate having a plurality of second portions with each respective one of said second portions corresponding to a respective one of said first portions, each respective second portion having a top area which protrudes from a second surface of said second member and including a piezoelectric material which is polarized in a direction parallel to an electrical field generated by an input signal, said second surface being in contact with said first surface so that the top area of each respective one of said second portions confronts a respective one of said first portions, a space between the top area of each respective one of said second portions and the bottom area of the respective one of said first portions defining an ink room.

30. The ink jet head as claimed in claim 29, wherein each of said plurality of second portions of said second member is a protrusion, and wherein protrusions in each adjacent pair of protrusions are separated from each other by a respective one of a plurality of grooves formed in said second member.

31. The ink jet head as claimed in claim 30, wherein each groove has a bottom surface which defines said second surface.

32. The ink jet head as claimed in claim 29, wherein each second portion extends into the respective one of said first portions.

33. The ink jet head as claimed in claim 29, wherein each first portion of said first member is a groove formed in said first surface of said first member.

34. The ink jet head as claimed in claim 29, wherein a plurality of first electrodes are provided on the top areas of said second portions, respectively, and a second electrode is provided on a third surface of said second member opposing to said second surface.

35. The ink jet head as claimed in claim 29, wherein said second surface is in contact with said first surface through a glue.

36. The ink jet head as claimed in claim 29, wherein the piezoelectric material of each second portion vibrates in a thickness vibration mode in response to the electrical field.

37. An ink jet recording apparatus for forming an ink image onto an ink carrier, comprising:

a base having a plurality of hollow portions, each hollow portion having a bottom area spaced from a first surface of said base;

a cover, said cover having a plurality of protruding portions with each respective one of said plurality of protruding portions corresponding to a respective one of said hollow portions, each protruding portion having a top area which protrudes from a second surface of said cover, each protruding portion including a piezoelectric material, said second surface being in contact with said first surface so that each protruding portion confronts a respective one of said hollow portions, a space between the top area of each respective one of said protruding portions and the bottom area of a respective one of said hollow portions defining an ink room; and a driver which is connected with said protruding portions to apply an input signal.

38. The ink jet recording apparatus as claimed in claim 37, wherein a depth of each hollow portion, defined by a respective bottom area and said first surface, is larger than a height of the respective protruding portion, defined by a respective top area and said second surface.

39. An ink jet head for jetting ink onto an ink carrier, comprising:

a base having a plurality of hollow portions, each hollow portion having a bottom area spaced from a first surface of said base; and a cover, said cover having a plurality of protruding portions with each respective one of said protruding portions corresponding to a respective one of said hollow portions, each protruding portion having a top area which protrudes from a second surface of said cover, each protruding portion including a piezoelectric material, said second surface being in contact with said first surface so that each respective one of said protruding portions confronts a respective one of said hollow portions, a space between the top area of each respective one of said protruding portions and the bottom area of the respective one of said hollow portions defining an ink room.

40. The ink jet head as claimed in claim 39, wherein a depth of each hollow portion defined by a bottom area and said first surface is larger than a height of the respective one of protruding portions defined by a top area and said second surface.

41. An ink jet recording apparatus for forming an ink image onto an ink carrier, comprising:

a base having a plurality of hollow portions, each hollow portion having a depth defined by a distance from a first surface of said base to a bottom area of that hollow portion;

a cover, said cover having a plurality of protruding portions with each respective one of said protruding portions corresponding to a respective one of said hollow portions, each protruding portion having a height defined by a distance from a second surface of said cover to a top area of that protruding portion, said height being smaller than said depth, each protruding portion including a piezoelectric material, said second surface being in contact with said first surface so that each respective one of said protruding portions confronts a respective one of said hollow portions; and a driver which is connected with said second portions to apply an input signal.

42. An ink jet head for jetting ink onto an ink carrier, comprising:

a base having a plurality of hollow portions, each hollow portion having a depth defined by a distance from a first surface of said base to a bottom area of that hollow portion; and a cover, said cover having a plurality of protruding portions with each respective one of said protruding portions corresponding to a respective one of said hollow portions, each protruding portion having a height defined by a distance from a second surface of said cover to a top area of that protruding portion, said height being smaller than said depth, each protruding portion including a piezoelectric material, said second surface being in contact with said first surface so that each respective one of said protruding portions confronts a respective one of said hollow portions.

43. An ink jet recording apparatus for forming an ink image onto an ink carrier, comprising:

a base having a plurality of hollows, each hollow having a bottom area which is spaced from a first surface of said base;

a cover, said cover having a plurality of portions with each respective one of said plurality of portions corresponding to a respective one of said hollows, each portion being a protrusion that protrudes from a second surface of said cover, at least a part of each portion being made of a piezoelectric material, said cover being engaged with said base so that each respective one of said portions confronts a respective one of said hollows, and so that said first surface is in contact with said second surface, a space between each respective one of said portions and the respective one of said hollows defining an ink room; and a driver which is connected with said portions to drive said portions.

44. The ink jet recording apparatus as claimed in claim 43, wherein said driver comprises a plurality of electrodes provided corresponding to said portions, respectively.

45. The ink jet recording apparatus as claimed in claim 43, wherein each hollow of said base is a longitudinally extending groove formed in said first surface of said base.

46. An ink jet head for jetting ink onto an ink carrier, comprising:

a base having a plurality of hollows, each hollow having a bottom area which is spaced from a first surface of said base; and a cover, said cover having a plurality of portions with each respective one of said portions corresponding to a respective one of said hollows, each respective one of said portions being a protrusion which protrudes from a second surface of said cover, at least a part of each portion being made of a piezoelectric material, said cover being engaged with said base so that each respective one of said portions confronts a respective one of said hollows, and so that said first surface is in contact with said second surface, a space between each respective one of said protrusions and the respective one of said hollows defining an ink room.

47. The ink jet head as claimed in claim 46, further comprising:

a plurality of electrodes provided corresponding to said portions, respectively.

48. The ink jet head as claimed in claim 46, wherein each hollow of said base is a longitudinally extending groove formed in said first surface of said base.

49. An ink jet head comprising:

a first member having a plurality of grooves which are formed in a first surface of said first member so as to be aligned on said first surface of said first member; and a second member having a plurality of portions, each respective one of said portions being aligned with a respective corresponding one of said grooves in said first member, each of said portions including piezoelectric material and a pair of electrodes, a second surface of said second member being in contact with said first surface of said first member whereby each respective one of said portions confronts a respective one of said grooves and a space for an ink room is formed between each respective one of said portions and the respective one of said grooves, each respective one of said portions projecting into the respective one of said grooves.

50. An ink jet head comprising:

a first member having a plurality of grooves which are formed in a first surface of said first member so as to be aligned on said first surface of said first member; and a second member having a second surface which is in contact with said first surface, said second member having a plurality of portions with each respective one of said portions corresponding to a respective one of said grooves, each of said portions projecting into a respective one of said grooves, each respective one of said portions including piezoelectric material which is sandwiched by a first electrode and a second electrode, each of the first electrodes being provided on a surface of a respective one of said piezoelectric materials opposing a respective one of said grooves, each of the second electrodes being provided on a surface of a respective one of said piezoelectric materials opposing the surface of the respective one of said piezoelectric materials on which a respective one of said first electrodes is provided.

51. The ink jet head as claimed in claim 50, wherein an electric field is generated between respective ones of said first electrodes and respective ones of said second electrodes by application of electrical voltage therebetween.

52. The ink jet head as claimed in claim 51, wherein each of said piezoelectric materials is polarized in a direction along which the electric field is generated.

53. An ink jet head comprising:

a first member which has a plurality of first portions and a plurality of second portions wherein said first portions alternate with said second portions, and wherein each of said first portions has a thickness which is greater than a thickness of each of said second portions; and a second member which has a plurality of third portions and a plurality of fourth portions, said third portions alternating with said fourth portions, each of said third portions having a thickness which is smaller than a thickness of each of said fourth portions:

said first member and said second member being positioned with respect to one another so that a position of each respective one of said third portions corresponds to a position of a respective one of said first portions and a position of each respective one of said fourth portions corresponds to a position of a respective one of said second portions, each respective one of said third portions being in contact with the respective one of said first portions;

each of said fourth portions comprising, from a side of a respective one of said second portions: a first electrode, a piezoelectric material, and a second electrode.

54. The ink jet head as claimed in claim 53, wherein said piezoelectric material is polarized in a direction along which the first electrode, the piezoelectric material, and the second electrode are aligned.

55. The ink jet head as claimed in claim 53, wherein at least one of the first electrode and the second electrode is covered with dielectric material.

56. An ink jet head comprising:

a first member which has a plurality of first portions and a plurality of second portions, wherein said first portions alternate with said second portions, and wherein each of said first portions has a thickness which is greater than a thickness of each of said second portions; and a second member which has a plurality of third portions and a plurality of fourth portions, said third portions alternating with said fourth portions, each of said third portions having a thickness which is less than a thickness of each of said fourth portions;

said first member and said second member being positioned with respect to each other so that a position of each respective one of said third portions corresponds to a position of a respective one of said first portions and a position of each respective one of said fourth portions corresponds to a position of a respective one of said second portions, each respective one of said third portions being in contact with a respective one of said first portions so that a space formed between each respective one of said fourth portions and the respective one of said second portions is usable as an ink room;

each of said fourth portions comprising, from a side of a respective one of said second portions: a respective first electrode, a respective piezoelectric material, and a respective second electrode.

57. The ink jet head as claimed in claim 56, wherein the respective piezoelectric material is polarized in a direction along which the respective first electrode, the respective piezoelectric material, and the respective second electrode are aligned.

58. The ink jet head as claimed in claim 56, wherein at least one of the respective first electrode and the respective second electrode is covered with dielectric material.

59. An ink jet head comprising:

a first member which has a plurality of first portions and a plurality of second portions wherein said first portions alternate with said second portions, and wherein each of said first portions has a thickness which is greater than a thickness of each of said second portions; and a second member which has a plurality of third portions and a plurality of fourth portions, said third portions alternating with said fourth portions, each of said third portions having a thickness which is smaller than a thickness of each of said fourth portions, a difference between the thickness of said third portions and the thickness of said fourth portions being smaller than a difference between the thickness of said first portions and the thickness of said second portions;

said first member and said second member being positioned with respect to one another so that a position of each respective one of said third portions corresponds to a position of a respective one of said first portions and a position of each respective one of said fourth portions corresponds to a position of a respective one of said second portions, each of said third portions being in contact with a respective one of said first portions so that a space formed between each respective one of said fourth portions and the respective one of said second portions is usable as an ink room;

each of said fourth portions comprising, from a side of a respective one of said second portions: a respective first electrode, a respective piezoelectric material, and a respective second electrode.

60. The ink jet head as claimed in claim 59, wherein the respective piezoelectric material is polarized in a direction along which the respective first electrode, the respective piezoelectric material, and the respective second electrode are aligned.

61. The ink jet head as claimed in claim 59, wherein at least one of the respective first electrode and the respective second electrode is covered with dielectric material.

62. An ink jet head comprising:

a first member which has a plurality of first portions and a plurality of second portions, said first portions being aligned in a line, each respective one of said second portions being located between a respective pair of neighboring first portions, each of said first portions having a thickness which is greater than a thickness of each of said second portions; and a second member which has a plurality of third portions and a plurality of fourth portions, each of said third portions having a thickness which is smaller than a thickness of each of said fourth portions;

said first member and said second member being positioned with respect to one another so that a position of each respective one of said third portions corresponds to a position of a respective one of said first portions and a position of each respective one of said fourth portions corresponds to a position of a respective one of said second portions, each respective one of said third portions being in contact with a respective one of said first portions;

each of said fourth portions comprising, from a side of a respective one of said second portions: a respective first electrode, a respective piezoelectric material, and a respective second electrode; each of said first and second electrodes being provided separately from others of said first and second electrodes with respect to a direction along which said first portions are aligned.

63. The ink jet head as claimed in claim 62, wherein the respective piezoelectric material can be vibrated by applying an electrical voltage between the respective first electrode and the respective second electrode.

* * * * *